US007665174B2

(12) United States Patent
Basham et al.

(10) Patent No.: US 7,665,174 B2
(45) Date of Patent: Feb. 23, 2010

(54) CLEANING HEAD FOR USE IN A FLOOR CLEANING MACHINE

(75) Inventors: Michael T. Basham, Maple Grove, MN (US); Warren L. Larson, Maple Grove, MN (US); Terence A. Peterson, Plymouth, MN (US); Barbara J. Peterson, legal representative, Plymouth, MN (US); Richard W. Wellens, Plymouth, MN (US); Mark J. Fleigle, Maple Grove, MN (US)

(73) Assignee: Tennant Company, Minneapolis, MN (US)

( * ) Notice: Subject to any disclaimer, the term of this patent is extended or adjusted under 35 U.S.C. 154(b) by 585 days.

(21) Appl. No.: 11/429,398

(22) Filed: May 5, 2006

(65) Prior Publication Data

US 2006/0282965 A1 Dec. 21, 2006

Related U.S. Application Data

(60) Provisional application No. 60/678,049, filed on May 5, 2005.

(51) Int. Cl.
*A47L 11/18* (2006.01)
*A47L 11/282* (2006.01)

(52) U.S. Cl. ..... 15/52.1; 15/50.3; 15/98; 15/340.4; 15/366; 15/384

(58) Field of Classification Search ..... 15/50.3, 15/52.1, 82, 83, 98, 340.4, 366, 384
See application file for complete search history.

(56) References Cited

U.S. PATENT DOCUMENTS 478,942 A * 7/1892 Pease ..... 15/83
557,377 A * 3/1896 Gee et al. ..... 15/51

(Continued)

FOREIGN PATENT DOCUMENTS

DE 3841177 * 6/1990

(Continued)

OTHER PUBLICATIONS http://www.stolzenberg.de/eng/technik, "The high point in the world of sweeper technology," Techik, 2 pages, May 4, 2005.

(Continued)

*Primary Examiner*—Mark Spisich
(74) *Attorney, Agent, or Firm*—Westman, Champlin & Kelly, P.A.

(57) ABSTRACT

A cleaning head for use with a floor cleaning machine comprises first and second cleaning tools, at least one motor and a cleaning tool support. The at least one motor is configured to respectively drive rotation of the first and second cleaning tools about first and second horizontal axes. The first and second cleaning tools each have an exterior cleaning surface configured to engage the floor during floor cleaning operations. The cleaning tool support is configured to support the first and second cleaning tools for movement of the first and second horizontal axes relative to each other in a plane that is transverse to the first and second horizontal axes. Another embodiment of the invention is directed to a floor cleaning machine that includes embodiments of the cleaning head.

20 Claims, 6 Drawing Sheets

U.S. PATENT DOCUMENTS

| | | | | | |
|---|---|---|---|---|---|
| 644,739 | A | * | 3/1900 | Greeley et al. | 15/82 |
| 1,546,531 | A | * | 7/1925 | Anderson | 15/52 |
| 1,791,812 | A | * | 2/1931 | Harrison | 15/52.1 |
| 2,563,151 | A | | 8/1951 | Bjorksten | |
| 2,651,803 | A | * | 9/1953 | Browne | 15/373 |
| 2,731,659 | A | | 1/1956 | Coplen | |
| 2,913,744 | A | * | 11/1959 | Gregersen | 15/83 |
| 2,993,494 | A | | 7/1961 | Svensson | |
| 3,037,887 | A | | 6/1962 | Brenner et al. | |
| 3,078,190 | A | | 2/1963 | Blaser et al. | |
| 3,162,427 | A | | 12/1964 | Knudson et al. | |
| 3,212,762 | A | | 10/1965 | Carroll et al. | |
| 3,231,134 | A | | 1/1966 | Webster | |
| 3,392,418 | A | | 7/1968 | Schowalter | |
| 3,436,262 | A | | 4/1969 | Crowe et al. | |
| 3,453,678 | A | | 7/1969 | Gehman et al. | |
| 3,456,279 | A | | 7/1969 | Koland | |
| 3,460,717 | A | | 8/1969 | Thomas | |
| 3,490,948 | A | | 1/1970 | Farison | |
| 3,535,162 | A | | 10/1970 | Bray et al. | |
| 3,549,420 | A | | 12/1970 | Cunningham | |
| 3,655,096 | A | | 4/1972 | Easter | |
| 3,676,889 | A | | 7/1972 | Edlin | |
| 3,761,987 | A | | 10/1973 | Nayfa et al. | |
| 3,761,988 | A | | 10/1973 | Overton | 15/83 |
| 3,774,262 | A | | 11/1973 | Anthony et al. | |
| 3,789,449 | A | | 2/1974 | MacFarland et al. | |
| 3,823,727 | A | | 7/1974 | Fry | |
| 3,931,662 | A | | 1/1976 | Nayfa et al. | |
| 3,938,212 | A | | 2/1976 | Krier et al. | |
| 3,940,826 | A | | 3/1976 | Phillips et al. | |
| 3,942,218 | A | | 3/1976 | Krier et al. | |
| 3,974,541 | A | | 8/1976 | Silvis et al. | |
| 3,979,789 | A | | 9/1976 | Peabody et al. | |
| 4,000,536 | A | | 1/1977 | Nayfa et al. | |
| 4,014,808 | A | | 3/1977 | Herpers, Jr. et al. | |
| 4,032,307 | A | | 6/1977 | Sommerfeld | |
| 4,037,289 | A | | 7/1977 | Dojan | |
| 4,041,567 | A | | 8/1977 | Burgoon | |
| D245,994 | S | | 10/1977 | Olson | |
| 4,061,001 | A | | 12/1977 | Von der Eltz et al. | |
| 4,096,084 | A | | 6/1978 | Thomsen et al. | |
| 4,099,285 | A | | 7/1978 | Christensen et al. | |
| 4,107,075 | A | | 8/1978 | Kramer | |
| 4,133,773 | A | | 1/1979 | Simmons | |
| 4,138,756 | A | | 2/1979 | Krier et al. | |
| RE29,957 | E | | 4/1979 | Kasper | |
| 4,167,798 | A | | 9/1979 | Kltigl et al. | |
| 4,167,799 | A | | 9/1979 | Webb | |
| 4,173,056 | A | | 11/1979 | Geyer | |
| 4,191,590 | A | | 3/1980 | Sundheim | |
| 4,194,263 | A | | 3/1980 | Herpers et al. | |
| 4,206,530 | A | | 6/1980 | Kroll et al. | |
| 4,210,978 | A | | 7/1980 | Johnson et al. | |
| D257,845 | S | | 1/1981 | Peabody et al. | |
| 4,250,592 | A | | 2/1981 | Emrick | |
| 4,258,451 | A | | 3/1981 | Sommerfeld | |
| 4,262,382 | A | | 4/1981 | Brown et al. | |
| 4,295,244 | A | | 10/1981 | Herpers et al. | |
| 4,310,944 | A | | 1/1982 | Kroll et al. | |
| 4,320,556 | A | | 3/1982 | Kimzey et al. | |
| 4,334,335 | A | | 6/1982 | Brown et al. | |
| 4,345,353 | A | | 8/1982 | Sommerfeld | |
| 4,346,494 | A | | 8/1982 | Peabody et al. | |
| 4,348,783 | A | | 9/1982 | Swanson et al. | |
| 4,355,435 | A | | 10/1982 | Kimzey et al. | |
| 4,365,189 | A | | 12/1982 | Hawkins et al. | |
| 4,369,544 | A | | 1/1983 | Parisi | |
| D267,824 | S | | 2/1983 | Mannelly | |
| 4,373,227 | A | | 2/1983 | Kimzey et al. | |
| 4,377,017 | A | | 3/1983 | Herpers et al. | |
| 4,378,855 | A | | 4/1983 | Haub et al. | |
| 4,393,538 | A | | 7/1983 | Olson | |
| 4,419,141 | A | | 12/1983 | Kunkel | |
| 4,429,432 | A | | 2/1984 | Copeland et al. | |
| D273,620 | S | | 4/1984 | Kimzey et al. | |
| D273,621 | S | | 4/1984 | Haub et al. | |
| D273,622 | S | | 4/1984 | Brown et al. | |
| 4,457,036 | A | | 7/1984 | Carlson et al. | |
| 4,511,486 | A | | 4/1985 | Shah | |
| 4,557,739 | A | | 12/1985 | Fortman et al. | |
| 4,570,856 | A | | 2/1986 | Groth et al. | |
| 4,571,771 | A | | 2/1986 | Worwa | |
| 4,580,313 | A | | 4/1986 | Blehert | |
| 4,586,208 | A | | 5/1986 | Trevarthen | |
| 4,595,420 | A | | 6/1986 | Williams, III et al. | |
| 4,608,086 | A | | 8/1986 | Dodge | |
| 4,615,070 | A | | 10/1986 | Frederick et al. | |
| 4,624,026 | A | | 11/1986 | Olson et al. | |
| 4,634,403 | A | | 1/1987 | Peabody et al. | |
| 4,667,364 | A | | 5/1987 | Meili | |
| 4,675,935 | A | | 6/1987 | Kasper et al. | |
| 4,676,287 | A | | 6/1987 | Fitzwater | |
| 4,676,926 | A | | 6/1987 | Kappler | |
| 4,679,271 | A | | 7/1987 | Field et al. | |
| 4,709,771 | A | | 12/1987 | Basham et al. | |
| 4,729,141 | A | | 3/1988 | Berg et al. | |
| 4,757,566 | A | | 7/1988 | Field et al. | |
| 4,768,311 | A | | 9/1988 | Olson | |
| 4,780,243 | A | | 10/1988 | Edgley et al. | |
| 4,805,256 | A | | 2/1989 | Mason et al. | |
| 4,805,258 | A | | 2/1989 | Sitarski et al. | |
| 4,817,233 | A | | 4/1989 | Waldhauser | |
| 4,819,676 | A | | 4/1989 | Blehert et al. | |
| 4,822,431 | A | | 4/1989 | Bricher et al. | |
| 4,838,457 | A | | 6/1989 | Swahl et al. | |
| 4,849,027 | A | | 7/1989 | Simmons | |
| 4,866,804 | A | | 9/1989 | Masbruch et al. | |
| 4,881,288 | A | | 11/1989 | May et al. | |
| 4,903,718 | A | | 2/1990 | Sullivan | |
| 4,913,316 | A | | 4/1990 | Richter | |
| 4,967,064 | A | | 10/1990 | Field et al. | |
| 4,974,618 | A | | 12/1990 | Nysted | |
| 4,986,378 | A | | 1/1991 | Kasper | |
| 4,996,468 | A | | 2/1991 | Field et al. | |
| 5,013,333 | A | | 5/1991 | Beaufoy et al. | |
| 5,016,310 | A | | 5/1991 | Geyer et al. | |
| 5,031,837 | A | | 7/1991 | Hanish | |
| 5,044,043 | A | | 9/1991 | Basham et al. | |
| 5,045,118 | A | | 9/1991 | Mason et al. | |
| 5,060,342 | A | | 10/1991 | Brazier | |
| 5,064,010 | A | | 11/1991 | Masbruch et al. | |
| 5,088,149 | A | | 2/1992 | Berg et al. | |
| 5,093,955 | A | | 3/1992 | Blehert et al. | |
| RE33,926 | E | | 5/1992 | Waldhauser | |
| 5,116,425 | A | | 5/1992 | Ruef | |
| 5,133,107 | A | | 7/1992 | MacDonald | |
| 5,207,642 | A | | 5/1993 | Orkin et al. | |
| 5,212,848 | A | | 5/1993 | Geyer | |
| 5,213,120 | A | | 5/1993 | Dickson | |
| 5,231,725 | A | | 8/1993 | Hennessey et al. | |
| 5,244,003 | A | | 9/1993 | Boomgaarden | |
| 5,254,146 | A | | 10/1993 | Beaufoy | |
| 5,276,933 | A | | 1/1994 | Hennessey et al. | |
| 5,295,277 | A | | 3/1994 | Koenigs et al. | |
| 5,303,448 | A | | 4/1994 | Hennessey et al. | |
| 5,319,828 | A | | 6/1994 | Waldhauser et al. | |
| 5,331,713 | A | | 7/1994 | Tipton | |
| 5,383,605 | A | | 1/1995 | Teague | |
| RE35,033 | E | | 9/1995 | Waldhauser | |
| 5,455,982 | A | | 10/1995 | Armstrong et al. | |
| 5,455,985 | A | | 10/1995 | Hamline et al. | |
| 5,462,607 | A | | 10/1995 | Mestetsky et al. | |
| 5,483,718 | A | | 1/1996 | Blehert et al. | |

| | | | |
|---|---|---|---|
| D369,446 | S | 4/1996 | Smith |
| 5,509,972 | A | 4/1996 | Akazawa et al. |
| 5,515,568 | A | 5/1996 | Larson et al. |
| 5,526,547 | A | 6/1996 | Williams et al. |
| 5,535,476 | A | 7/1996 | Kresse et al. |
| 5,566,422 | A | 10/1996 | Geyer |
| 5,593,091 | A | 1/1997 | Harris |
| 5,611,106 | A | 3/1997 | Wulff |
| 5,611,108 | A | 3/1997 | Knowlton et al. |
| 5,647,093 | A | 7/1997 | Engel et al. |
| 5,649,643 | A | 7/1997 | Ridgeway |
| 5,659,918 | A | 8/1997 | Anthony et al. |
| 5,659,921 | A | 8/1997 | Narayan |
| 5,711,775 | A | 1/1998 | Field et al. |
| 5,735,017 | A | 4/1998 | Barnes et al. |
| 5,738,248 | A | 4/1998 | Green |
| 5,784,755 | A | 7/1998 | Karr et al. |
| 5,802,665 | A | 9/1998 | Knowlton et al. |
| 5,813,086 | A | 9/1998 | Ueno et al. |
| 5,816,298 | A | 10/1998 | Stricklin et al. |
| 5,829,094 | A | 11/1998 | Field et al. |
| 5,829,095 | A | 11/1998 | Legatt et al. |
| 5,836,045 | A | 11/1998 | Anthony et al. |
| 5,853,814 | A | 12/1998 | Murphy |
| 5,871,152 | A | 2/1999 | Saney |
| 5,884,353 | A | 3/1999 | Berg et al. |
| 5,893,189 | A | 4/1999 | D'Costa |
| 5,901,407 | A | 5/1999 | Boomgaarden |
| 5,940,928 | A | 8/1999 | Erko |
| 5,940,929 | A | 8/1999 | Berg |
| 5,943,724 | A | 8/1999 | Erko et al. |
| 5,943,730 | A | 8/1999 | Boomgaarden |
| 5,943,733 | A | 8/1999 | Tagliaferri |
| 5,967,747 | A | 10/1999 | Burke et al. |
| 5,983,447 | A | 11/1999 | Boomgaarden |
| 5,991,953 | A | 11/1999 | Durenberger et al. |
| 5,996,173 | A | 12/1999 | Engel et al. |
| 5,996,174 | A | 12/1999 | Boomgaarden et al. |
| 6,003,186 | A | 12/1999 | Larson |
| 6,017,163 | A | 1/2000 | Keppers |
| 6,018,844 | A | 2/2000 | Basham et al. |
| 6,035,479 | A | 3/2000 | Basham et al. |
| 6,041,472 | A | 3/2000 | Kasen et al. |
| 6,070,290 | A | 6/2000 | Schwarze et al. |
| 6,073,295 | A | 6/2000 | Durenberger et al. |
| 6,081,962 | A | 7/2000 | Kasen et al. |
| 6,090,217 | A | 7/2000 | Kittle |
| 6,092,261 | A | 7/2000 | Boomgaarden |
| 6,108,859 | A | 8/2000 | Burgoon |
| 6,117,200 | A | 9/2000 | Berg et al. |
| 6,125,495 | A | 10/2000 | Berg et al. |
| 6,131,766 | A | 10/2000 | King et al. |
| 6,134,744 | A | 10/2000 | Kasen et al. |
| 6,148,476 | A | 11/2000 | Legatt et al. |
| 6,192,542 | B1 | 2/2001 | Frederick et al. |
| 6,192,549 | B1 | 2/2001 | Kasen et al. |
| 6,202,243 | B1 | 3/2001 | Beaufoy et al. |
| 6,206,980 | B1 | 3/2001 | Robinson |
| 6,209,756 | B1 | 4/2001 | Van Der Heijden |
| 6,249,926 | B1 | 6/2001 | Wulff |
| 6,276,613 | B1 | 8/2001 | Kramer |
| 6,279,196 | B2 | 8/2001 | Kasen et al. |
| 6,283,221 | B2 | 9/2001 | Hurray et al. |
| 6,286,169 | B1 | 9/2001 | D'Costa et al. |
| 6,389,641 | B1 | 5/2002 | Boomgaarden et al. |
| 6,397,429 | B1 | 6/2002 | Legatt et al. |
| 6,398,829 | B1 | 6/2002 | Shinler et al. |
| 6,401,294 | B2 | 6/2002 | Kasper |
| 6,418,586 | B2 | 7/2002 | Fulghum |
| 6,421,870 | B1 | 7/2002 | Basham et al. |
| 6,425,958 | B1 | 7/2002 | Giddings et al. |
| 6,427,285 | B1 | 8/2002 | Legatt et al. |
| 6,428,590 | B1 | 8/2002 | Lehman et al. |
| 6,442,789 | B1 | 9/2002 | Legatt et al. |
| 6,444,003 | B1 | 9/2002 | Sutcliffe |
| 6,449,793 | B2 | 9/2002 | D'Costa et al. |
| 6,467,122 | B2 | 10/2002 | Lenkiewicz et al. |
| 6,505,379 | B2 | 1/2003 | Keller |
| 6,507,968 | B1 | 1/2003 | Hansen |
| 6,519,808 | B2 | 2/2003 | Legatt et al. |
| 6,523,992 | B1 | 2/2003 | Bublewitz et al. |
| 6,530,102 | B1 | 3/2003 | Pierce et al. |
| 6,530,117 | B2 | 3/2003 | Peterson |
| 6,543,580 | B1 | 4/2003 | Gathmann et al. |
| 6,550,099 | B2 | 4/2003 | Worwag |
| 6,571,423 | B1 | 6/2003 | Lijzenga et al. |
| 6,585,827 | B2 | 7/2003 | Field et al. |
| 6,602,018 | B2 | 8/2003 | Feeny et al. |
| 6,614,195 | B2 | 9/2003 | Bushey et al. |
| 6,618,888 | B2 | 9/2003 | Joynt et al. |
| 6,640,386 | B2 | 11/2003 | Morgan et al. |
| 6,647,585 | B1 | 11/2003 | Robinson |
| 6,651,286 | B2 | 11/2003 | Pierce |
| 6,662,402 | B2 | 12/2003 | Giddings et al. |
| 6,662,600 | B1 | 12/2003 | Field et al. |
| D485,175 | S | 1/2004 | Field et al. |
| 6,671,925 | B2 | 1/2004 | Field et al. |
| 6,705,332 | B2 | 3/2004 | Field et al. |
| 6,735,811 | B2 | 5/2004 | Field et al. |
| 6,735,812 | B2 | 5/2004 | Hekman et al. |
| 6,742,219 | B2 | 6/2004 | Lenzmeier et al. |
| 6,789,290 | B2 | 9/2004 | Kent et al. |
| 6,795,995 | B1 | 9/2004 | Holbus |
| 6,802,098 | B2 | 10/2004 | Geyer et al. |
| 6,832,409 | B2 | 12/2004 | Morgan et al. |
| 6,836,919 | B2 | 1/2005 | Shinler |
| 6,842,942 | B2 | 1/2005 | Morgan et al. |
| 6,854,157 | B2 | 2/2005 | Strauser |
| 6,877,180 | B2 | 4/2005 | Wilmo et al. |
| 6,893,180 | B2 | 5/2005 | Hall et al. |
| 6,945,261 | B2 | 9/2005 | Wadsworth et al. |
| 2001/0022010 | A1 | 9/2001 | Kasper |
| 2002/0096258 | A1 | 7/2002 | Savas et al. |
| 2003/0019071 | A1 | 1/2003 | Field et al. |
| 2003/0029885 | A1 | 2/2003 | Kawolics et al. |
| 2004/0040102 | A1 | 3/2004 | Field et al. |
| 2004/0187895 | A1 | 9/2004 | Field et al. |
| 2004/0193519 | A1 | 9/2004 | Joynt |
| 2004/0221407 | A1 | 11/2004 | Field et al. |
| 2005/0217062 | A1 | 10/2005 | Field |
| 2006/0032519 | A1 | 2/2006 | Field |
| 2006/0048331 | A1 | 3/2006 | Rau et al. |

FOREIGN PATENT DOCUMENTS

| | | | |
|---|---|---|---|
| DE | 44 13 783 | A1 | 3/1995 |
| EP | 0173394 | | 8/1985 |
| EP | 0 744 148 | A2 | 11/1996 |
| EP | 1 044 645 | A2 | 10/2000 |
| JP | 11216092 | | 8/1999 |
| WO | WO 95/09557 | | 4/1995 |
| WO | WO 00/35333 | | 6/2000 |
| WO | WO 02/05047 | | 1/2002 |
| WO | WO 02/06435 | | 1/2002 |

OTHER PUBLICATIONS http://www.stolzenberg.de/eng/technik, "This revolution in the world of sweeping techology," Technik, 2 pages, May. 4, 2005.

Discover Magazine, Jun. 2002, "Does the Universe Exist if We Don't Observe It?", including cover, Table of Contents, and pp. 26 and 27.

Tennant 6200E Operator Manual, 330410, Rev. 08 (Mar. 2006), pp. 1-80.

* cited by examiner

FIG. 6
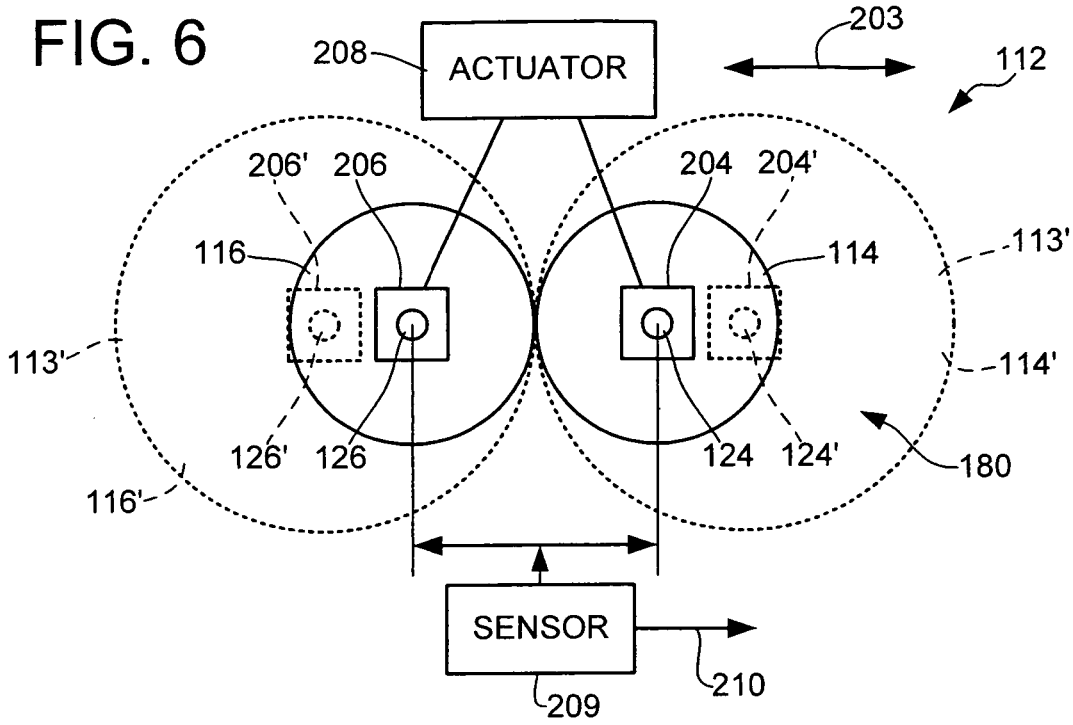
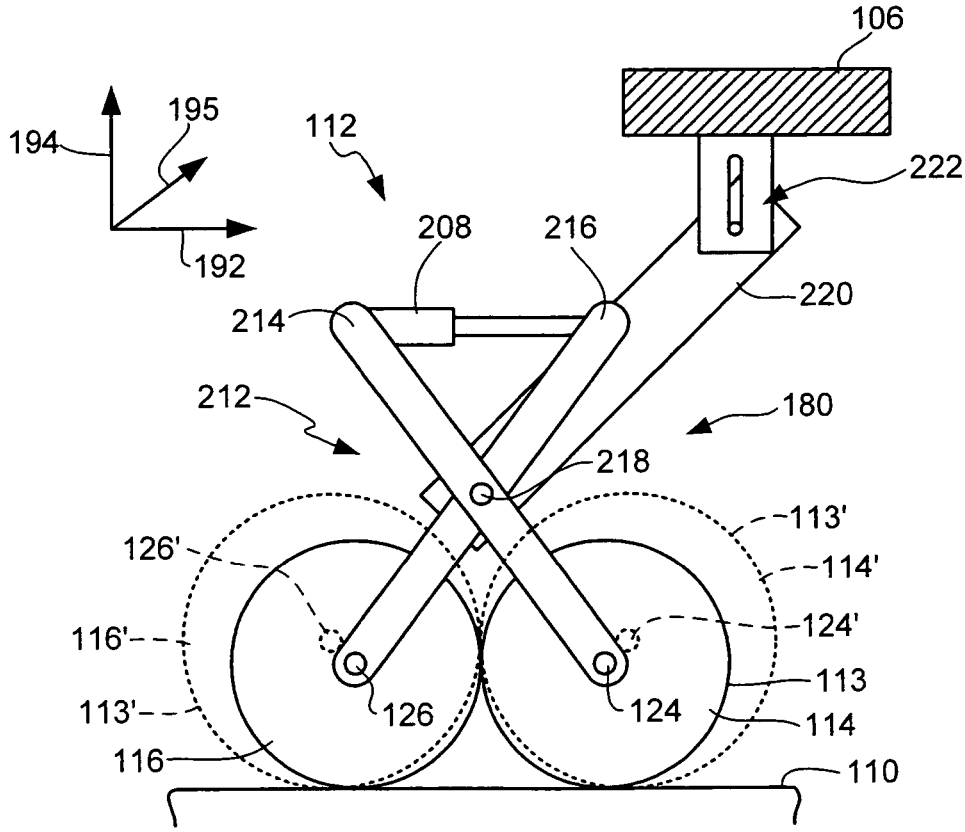
FIG. 7

CLEANING HEAD FOR USE IN A FLOOR CLEANING MACHINE

CROSS-REFERENCE TO RELATED APPLICATION

The present application is based on and claims the benefit of U.S. provisional patent application Ser. No. 60/678,049, filed May 5, 2005, the content of which is hereby incorporated by reference in its entirety.

FIELD OF THE INVENTION

The present invention generally relates to a cleaning head for use with a floor cleaning machine to perform floor cleaning operations and, more particularly, to a cleaning head comprising first and second cleaning tools that are movable within a plane that is transverse to their horizontal axes.

BACKGROUND OF THE INVENTION

Floor cleaning in public, commercial, institutional and industrial buildings have led to the development of various specialized floor cleaning machines, such as hard and soft floor cleaning machines. These cleaning machines generally utilize a cleaning head that includes one or more cleaning tools configured to perform the desired cleaning operation on the floor surface.

FIG. 9 is a perspective view of a hard floor sweeping and scrubbing machine 300 disclosed in U.S. Pat. No. 5,901,407, which is assigned to Tennant Company of Minneapolis, Minn. The machine 300 uses a cleaning head 302 having two cleaning tools 304 in the form of cylindrical brushes. The cleaning tools counter-rotate in the directions indicated by arrows 306 and 308. Water and detergent are sprayed on the floor ahead of the brushes so the brushes can scour the floor at the same time they are sweeping debris from the floor. A vacuum squeegee 310 removes liquid waste from the floor during the wet scrubbing and sweeping operations. The cleaning tools 304 engage each other such that debris on the floor is swept between the two cleaning tools and is directed into a waste hopper 312 by a deflector 314. Over time, the cleaning tools 304 will shrink due to wear resulting in a loss of engagement with each other and a reduction in sweeping performance.

There exists a continuous demand for improvements to floor sweeping and/or scrubbing machines including, for example, maintaining sweeping performance of the cleaning head as the cleaning tools wear and reducing wear on the cleaning tools.

The discussion above is merely provided for general background information and is not intended to be used as an aid in determining the scope of the claimed subject matter.

SUMMARY OF THE INVENTION

Embodiments of the present invention are generally directed to a cleaning head for use with a floor cleaning machine to perform a cleaning operation on a floor. One embodiment of the cleaning head comprises first and second cleaning tools, at least one motor and a cleaning tool support. The at least one motor is configured to respectively drive rotation of the first and second cleaning tools about first and second horizontal axes. The first and second cleaning tools each have an exterior cleaning surface configured to engage the floor during floor cleaning operations. The cleaning tool support is configured to support the first and second cleaning tools for movement of the first and second horizontal axes relative to each other in a plane that is transverse to the first and second horizontal axes.

Another embodiment of the invention is directed to a floor cleaning machine that includes embodiments of the cleaning head.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

BRIEF DESCRIPTION OF THE DRAWINGS

FIG. 6 is a simplified side view of a cleaning tool support of a cleaning head that facilitates relative movement of cleaning tools within a plane that lies transverse to the horizontal axes of the cleaning tools, in accordance with embodiments of the invention.

FIG. 7 is a simplified side view of a cleaning head in accordance with embodiments of the invention.

DETAILED DESCRIPTION OF ILLUSTRATIVE EMBODIMENTS

The present invention is generally directed to a cleaning head for use in a floor cleaning machine for performing a cleaning operation (i.e., sweeping, scrubbing, soil transfer, etc.) on a floor. Exemplary floors include indoor and outdoor hard floor surfaces (e.g., tile, cement, asphalt, etc.) and soft floor surfaces (e.g., carpet, rugs, artificial turf, etc.). Accordingly, the "floors" that can be cleaned using the cleaning head of the present invention include streets, sidewalks, tennis courts, basketball courts, football fields, and other outdoor hard and soft floor surfaces, as well as indoor hard and soft floor surfaces.

Figure 1:
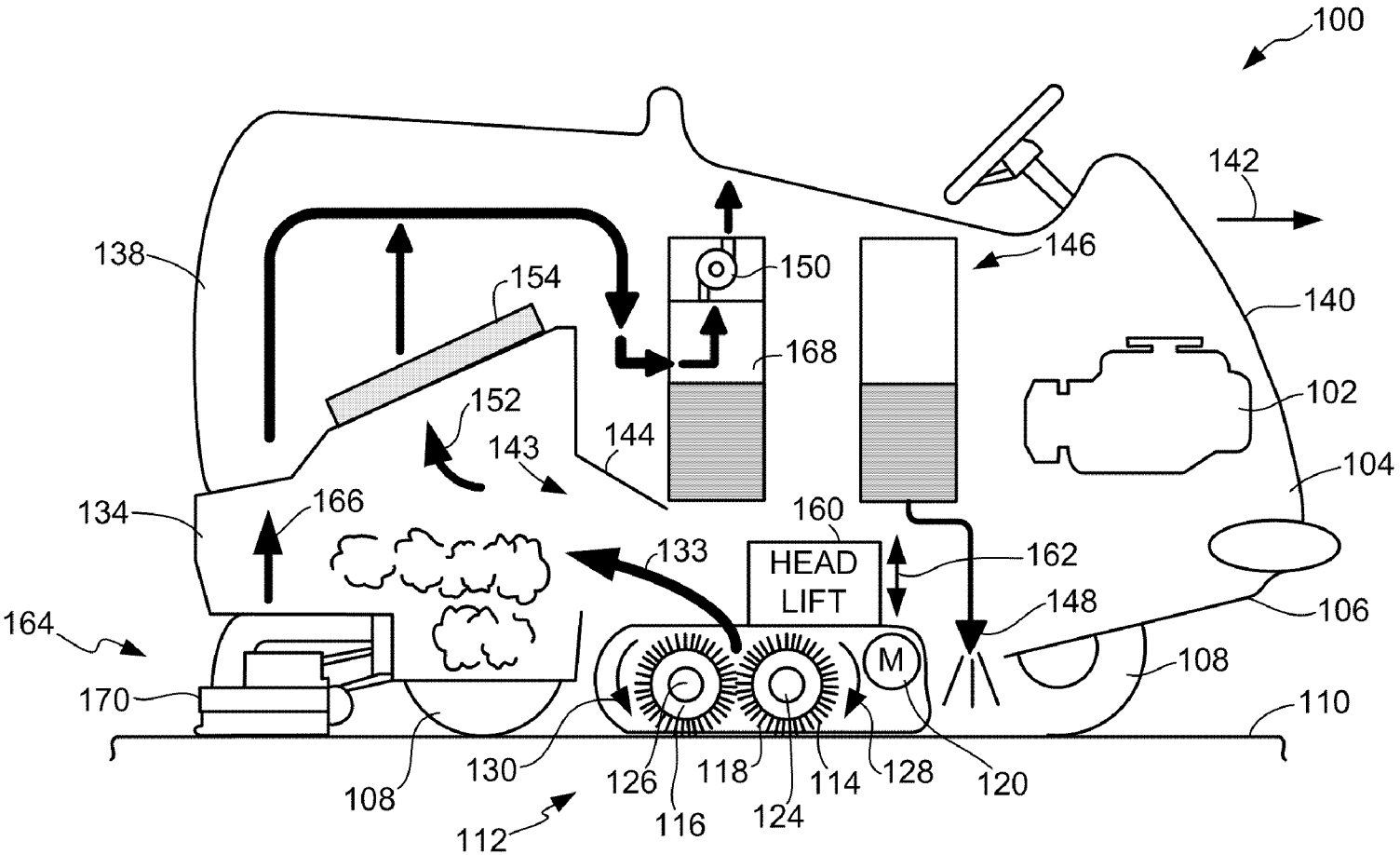
FIG. 1 is a simplified side view of a floor cleaning machine in accordance with embodiments of the invention.

FIG. 1 is simplified diagram cleaning machine 100 in accordance with embodiments of the invention. Although the machine 100 is depicted as a ride-on machine, the machine 100 may be designed for use by an operator that walks behind the machine, or the machine may be configured to be towed behind a vehicle. The machine 100 may be powered through an on-board power source, such as batteries or an internal combustion engine 102, or powered through an electrical cord.

Embodiments of the machine 100 include components that are supported on a motorized mobile body 104. One embodiment of the mobile body 104 comprises a frame 106 supported on wheels 108 for travel over a floor or surface 110, on which a cleaning operation is to be performed.

Figure 2:
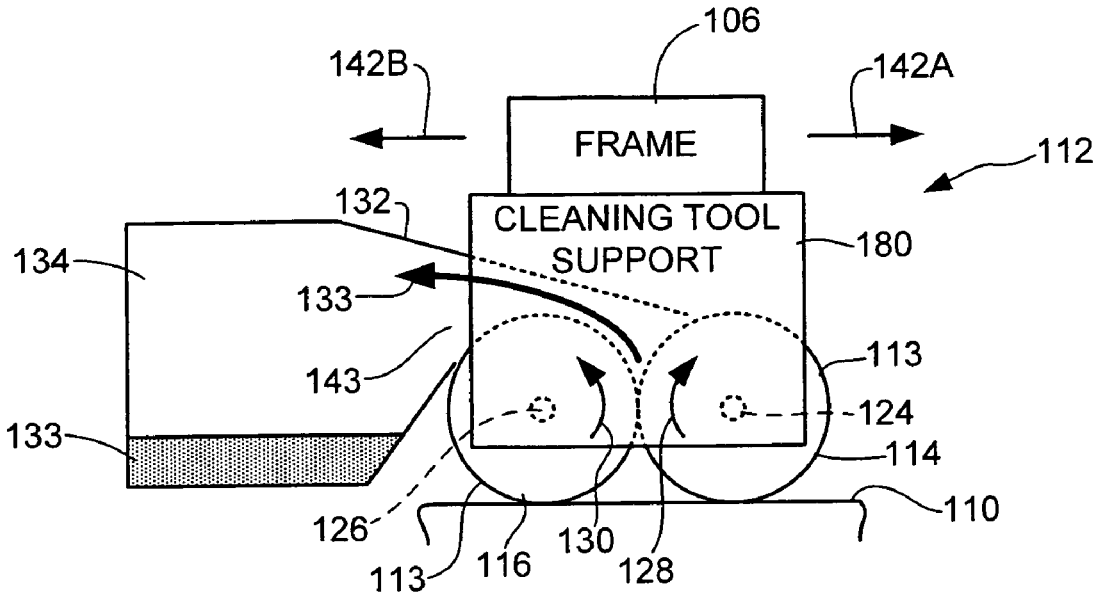
FIG. 2 is a simplified side view of a cleaning head and waste hopper in accordance with embodiments of the invention.

The machine 100 includes a motorized cleaning head 112 in accordance with embodiments of the invention and other components used to facilitate cleaning operations on the floor 110. The cleaning head 112 includes two cleaning tools 114 and 116, as shown in FIGS. 1 and 2. FIG. 2 is a simplified side view of the cleaning head 112 in accordance with embodiments of the invention. The cleaning tools each include an exterior cleaning surface 113 that is configured to facilitate at least a sweeping operation on the floor 110. In one embodiment, the cleaning tools 114 and 116 comprise one or more brushes and the exterior cleaning surfaces 113 include bristles 118 (FIG. 1) designed to perform a dry sweeping operation, a wet sweeping operation, and/or a wet sweeping and scrubbing operation on the floor 110. Other materials can also be used to form the exterior surfaces 113 of the cleaning tools 114 and 116, such as cloth, microfiber, and other conventional materials, depending on the desired cleaning operation to be performed. The details of the exterior surfaces 113 are not shown in FIG. 2 and subsequent figures to simplify the illustrations.

The cleaning tools 114 and 116 are driven by one or more motors 120 (FIG. 1) to respectively rotate the cleaning tools 114 and 116 about horizontal axes 124 and 126. Each of the horizontal axes 124 and 126 is substantially parallel to the floor 110, as illustrated in the simplified front view of the cleaning head 112 provided in FIG. 3. In one embodiment, the cleaning tools 114 and 116 are configured to counter-rotate in the directions indicated by arrows 128 and 130 in FIGS. 1 and 2. A deflector 132 extends over the surfaces 113 of the cleaning tools 114 and 116 and directs waste 133 swept from the floor 110 and between the cleaning tools 114 and 116 into a waste hopper 134. The waste hopper 134 can be positioned on either a rear side 138 of the cleaning head 112 (FIG. 1) or a front side 140 of the cleaning head 112, with the deflector 132 configured accordingly to direct the waste 133 into the hopper 134. Thus, the forward direction of the cleaner 100, indicated by arrow 142 in FIG. 1, can be that indicated by arrow 142A or 142B in FIG. 2.

During a dry sweeping operation, waste material 133 is swept by the cleaning tools 114 and 116 into the waste hopper 134 through an opening 143 that can be covered by a door 144, as shown in FIG. 1. In one embodiment, the machine 100 includes one or more dust control systems to reduce the amount of airborne dust that is generated during such dry sweeping operations.

In accordance with one embodiment of the invention, the dust control system comprises a liquid dispensing system 146, which includes a sprayer 148 on the front side 140 of the head 112. The liquid dispensing system 146 is configured to spray a dust control liquid, such as water or foam, to the surface 110 during dry sweeping operations. The amount of liquid applied to the surface 110 is much less than that applied during floor scrubbing operations, during which the complete wetting of the surface 110 is desired to remove embedded dirt on the surface 110. Thus, although the surface 110 may be slightly wetted, the sweeping operation is still considered to be a dry sweeping operation. With the surface slightly wetted, the sweeping operation performed by the cleaning tools 114 and 116 generates less airborne dust than that which would be generated if the surface 110 was completely dry.

In accordance with another embodiment, the machine 100 includes a vacuumized dust control system. The vacuumized dust control system includes a vacuum fan 150 that is placed in vacuum communication with the waste hopper 134. In one embodiment, the vacuum fan 150 and draws airborne dust (represented by arrow 152) into the machine 100 and through an air filter 154, which traps the dust.

In one embodiment, the machine 100 includes a head lift 160 that is configured to raise and lower the cleaning head 112, or at least the cleaning tools 114 and 116, relative to the frame 106 of the mobile body 104, as indicated by arrow 162 in FIG. 1. The head lift 160 can be used to raise the cleaning head 112 off the surface 110 during transport as well as control a pressure applied to the surface 110 by the cleaning tools 114 and 116 during cleaning operations.

In accordance with another embodiment, the cleaning head 112 is configured to perform wet scrubbing and sweeping operations on the floor 110, during which water or a cleaning liquid contained in the tank 146, or other container, is sprayed to the surface 110 in front of the cleaning head 112. The wetted debris on the surface 110 is swept into the waste hopper 134 by the cleaning tools 114 and 116 as discussed above while they also scrub the floor 110. Soiled cleaning liquid that remains on the floor 110 is then collected by a fluid recovery system 164 positioned on the rear side 138 of the cleaning head 112. The collected soiled cleaning liquid, represented by arrow 166, is then deposited in a waste recovery tank 168.

One embodiment of the fluid recovery system 164 of the machine 100 includes a vacuum squeegee 170, as shown in FIG. 1. The vacuum squeegee 170 generally extends across the width of the machine 100 and includes a vacuum port 172 that is placed in vacuum communication with the vacuum 150 using conduit or other conventional means. The vacuum 150 operates to remove liquid and particle waste, as indicated by arrow 166, collected by the vacuum squeegee 170 for deposit in the waste recovery tank 168.

In another embodiment, the cleaning tools 114 and 116 are configured to perform a soft floor cleaning operation (e.g., soil transfer or deep cleaning extraction) on a soft floor 110, such as carpet, fabric, artificial turf, or other surface. Exemplary cleaners and tools used for such cleaning operation are disclosed in U.S. Pat. No. 6,735,812, which is assigned to Tennant Company and is hereby incorporated by reference in its entirety.

Figure 3:
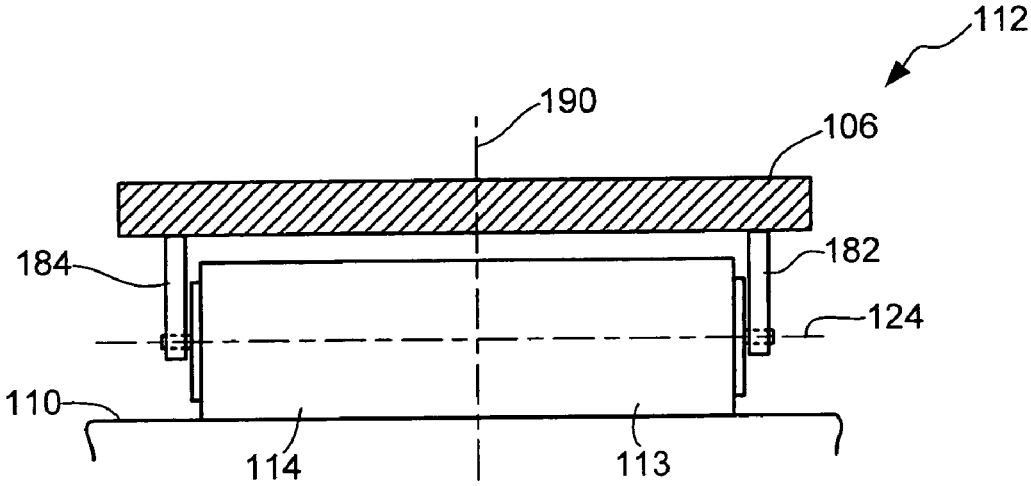
FIG. 3 is a simplified front view of a cleaning head in accordance with embodiments of the invention.

One embodiment of the cleaning head 112 includes a cleaning tool support 180, illustrated schematically in FIGS. 2 and 3, that is connected to the frame 106 of the mobile body through either the head lift 160 (if present) or other components. The cleaning tool support 180 comprises components for supporting the cleaning tools 114 and 116 for rotation about their horizontal axes 124 and 126, such as, for example, side members 182 and 184, shown in FIG. 3.

Embodiments of the cleaning tool support 180 also support the cleaning tools 114 and 116 for relative movement of their horizontal axes 124 and 126 in horizontal and/or vertical directions within a plane 190 (FIG. 3), as will be discussed with reference to FIGS. 4 and 5. The plane 190 is defined by a horizontal axis 192 that is oriented substantially parallel to the floor 110 and a vertical axis 194 that is perpendicular to the horizontal axis 192. The horizontal axis 192 and the vertical axis 194 are each transverse to the horizontal axes 124 and 126 of the cleaning tools 114 and 116. Thus, the plane 190 is transverse to the horizontal axes 124 and 126. In one embodiment, axis 195, which is perpendicular to both the horizontal axis 192 and the vertical axis 194, is substantially parallel to the horizontal axes 124 and 126 of the cleaning tools 114 and 116.

Figure 4:
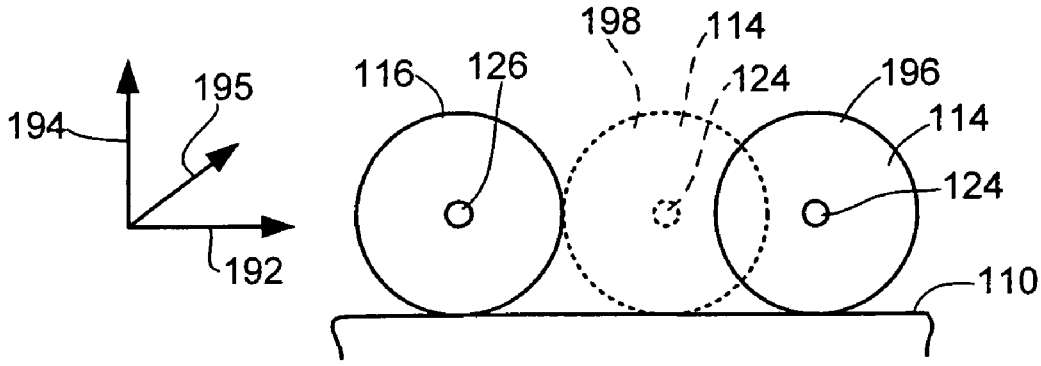
FIGS. 4 and 5 are simplified side views of cleaning tools of a cleaning head respectively illustrating movement relative to each other in horizontal and vertical directions within a plane that lies transverse to the horizontal axes of the cleaning tools.
Figure 5:
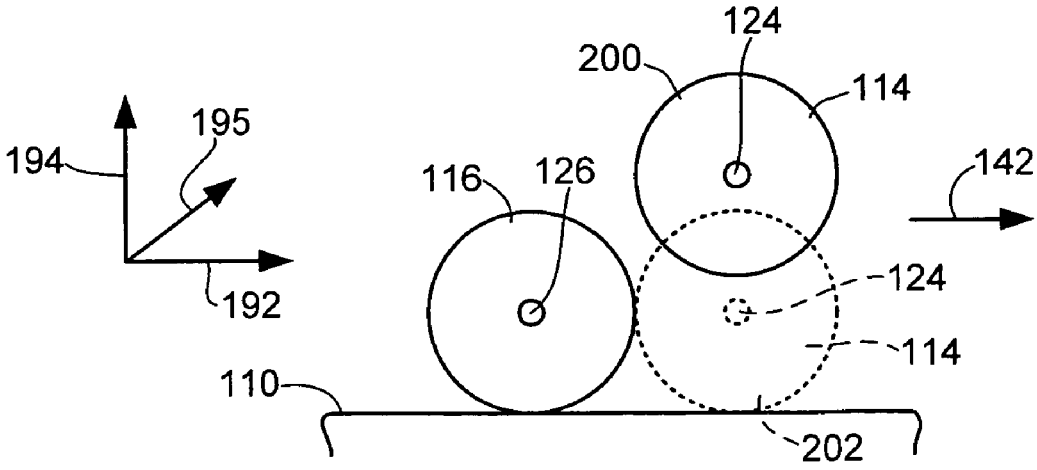

FIGS. 4 and 5 are simplified diagrams that illustrate relative movement of the cleaning tools 114 and 116 that is facilitated by the cleaning tool support 180, in accordance with embodiments of the invention. As shown in FIG. 4, one embodiment of the cleaning tool support 180 facilitates movement of the cleaning tool 114 relative to the cleaning tool 116 in a horizontal direction, which is along the horizontal axis 192, and within the plane 190. Thus, the cleaning tool support 180 supports the cleaning tool 114 for movement in the horizontal direction 192 within the plane 190 from a first position 196 to a second position 198 (shown in phantom) relative to the cleaning tool 116.

Additionally, as shown in FIG. 5, one embodiment of the cleaning tool support 180 facilitates movement of the cleaning tool 114 relative to the cleaning tool 116 in a vertical direction, which is along the vertical axis 194, and within the plane 190. Thus, the cleaning tool support 180 supports the cleaning tool 114 for movement in the vertical direction 194 within the plane 190 from a first position 200 to a second position 202 (shown in phantom) relative to the cleaning tool 116.

In accordance with embodiments of the invention, the relative movement of the cleaning tools 114 and 116 (i.e., their horizontal axes 124 and 126) within the plane 190 can occur during cleaning operations, such as sweeping operations, sweeping and scrubbing operations, soil transfer operations, and deep cleaning extraction operations, for example. As a result, it is unnecessary for an operator of the machine to adjust the cleaning tools, until it is time to replace them.

Those skilled in the art understand that the cleaning tool support 180 can be implemented in numerous ways. Accordingly, simplified illustrations are provided that represent the functionality of the basic components that can form the cleaning tool support in accordance with embodiments of the invention. It is also understood by those skilled in the art, the cleaning tool support 180 supports both ends of the cleaning tools 114 and 116, such as illustrated in FIG. 3, and the components described below and depicted as supporting one end of the cleaning tools 114 and 116 will generally have cooperating components supporting the opposing end of the cleaning tools 114 and 116 that allow for the desired relative movement of the horizontal axes 124 and 126 within the plane 190.

Over time, the cleaning surfaces 113 of the cleaning tools 114 and 116 wear due to abrasion during cleaning operations on the floor 110. Such wear will eventually degrade the cleaning performance of the cleaning head 112. For example, the sweeping performance of the cleaning head 112 will degrade as a result of a the formation of a gap between the cleaning surfaces 113 of the cleaning tools 114 and 116 due to a reduction in the diameter of the cleaning tools as they wear. Rather than forcing the replacement of the cleaning tools 114 and 116, embodiments of the cleaning tool support 180 are configured to maintain the close proximity the cleaning surfaces 113 to provide a high level of sweeping performance even as the surfaces 113 of the cleaning tools 114 and 116 wear, through the relative horizontal and/or vertical movement of the horizontal axes 124 and 126 within the plane 190.

FIG. 6 is a simplified diagram of components of one embodiment of the cleaning tool support 180 that facilitates relative movement of the horizontal axes 124 and 126 in the direction indicated by arrow 203 within the plane 190. Embodiments of the direction 203 include the horizontal direction 192, the vertical direction 194, a combination of both the horizontal direction 192 and vertical direction 194, and a non-linear path, such as an arc, within the plane 190.

One embodiment of the cleaning tool support 180 includes first and second supports 204 and 206 that support the cleaning tools 114 and 116 for rotation about the horizontal axes 124 and 126. At least one of the supports 204 or 206 is movable relative to the other support in the direction 203. In one embodiment, the cleaning head 112 includes an actuator 208 configured to drive the relative movement of the first and second horizontal axes 124 and 126 in the direction 203. In one embodiment, the actuator 208 is configured to apply a bias force (constant or variable) to bias the supports 204 and 206 and the attached cleaning tools 114 and 116 toward each other. The actuator 208 can comprise one or more springs, a linear actuator, a hydraulic actuator, components of the cleaning tool support such as supports 204 and 206 as well as other components described below, and other suitable components designed to drive the desired relative movement of the first and second cleaning tools 114 and 116 within the plane 190.

In one embodiment, the cleaning head 112 includes at least one sensor 209 configured to sense the relative positions of the cleaning tools 114 and 116, such as a spacing between the tools 114 and 116, and produce an output signal 210 that is indicative of the relative positions of the cleaning tools 114 and 116. Conventional methods and sensors 209 can be used to detect the relative positions of the tools 114 and 116. One embodiment of the actuator moves the cleaning tools 114 and 116 relative to each other in response to the signal 210.

In one embodiment, separate sensors 209 are be used to detect the relative positions of the cleaning tools 114 and 116 along the horizontal axis 192 and the vertical axis 194. Alternatively, a single sensor 209 can be used to detect the relative positions along both the horizontal axis 192 and the vertical axis 194.

In one embodiment, the sensor 209 directly senses the relative positions of the cleaning tools 114 and 116, such as through the detection of a spacing between the horizontal axes 124 and 126, as indicated by arrow 210, the detection of the spacing between the exterior surfaces 113, or other measurement of the relative positions of the cleaning tools 114 and 116.

In accordance with another embodiment, the sensor 209 indirectly detects the relative positions of the tools 114 and 116 through the detection of a height at which the cleaning tools are positioned when applying a desired pressure to the floor 110. This method can be used to estimate the diameters of the cleaning tools 114 and 116 at a given instant.

Other methods can also be used to estimate the relative positions of the cleaning tools 114 and 116 including the relative position or proximity of their cleaning surfaces 113, or the relative positions of the horizontal axes 124 and 126.

In one embodiment, the cleaning tool support 180 is configured to move the cleaning tools 114 and 116 relative to each other within the plane 190 to maintain the cleaning surfaces 113 in engagement or at least close proximity during cleaning operations as the cleaning tools 114 and 116 wear. For example, cleaning tools 114' and 116' and the corresponding supports 204' and 206', shown in phantom in FIG. 6, illustrate the position of the corresponding horizontal axes 124' and 126' when the cleaning tools are in a relatively non-worn state as compared to a later worn state represented by the cleaning tools 114 and 116. As the cleaning surfaces 113' of the cleaning tools 114' and 116' shrink due to wear, one or both of the supports 204' and 206' and the corresponding horizontal axes 124' and 126' move in the direction 203, such as the horizontal direction 192 or the vertical direction 194, as directed by the actuator 208. In one embodiment, the relative movement of the horizontal axes 124 and 126 to maintain the cleaning surfaces 113 of the cleaning tools 114 and 116 in close proximity to each other occurs automatically, such as in response to the sensor output signal 210, during cleaning operations and without significant operator intervention (i.e., manual adjustment of the positions of the cleaning tools).

FIG. 7 is a simplified side view of other embodiments of the cleaning tool support 180 that are configured to facilitate relative movement of the horizontal axes 124 and 126 of the cleaning tools 114 and 116 within the plane 190 and maintain engagement of the surfaces 113 of the cleaning tools 114 and 116 as they wear. In one embodiment, the cleaning tool support 180 includes a scissors linkage 212 and the actuator 208. The scissors linkage comprises a first arm 214 coupled to the cleaning tool 114 and a second arm 216 coupled to the cleaning tool 116. The coupling of the first and second arms 214 and 216 to the cleaning tools 114 and 116 involves attaching the arms to the components that support the cleaning tools for rotation about their respective horizontal axis. Alternatively, the arms 214 and 216 can provide such support, as illustrated in the simplified diagram of FIG. 7. A pivotal connection 218 joins the first and second arms 214 and 216 such that they pivot about the pivotal connection 218 relative to each other.

The actuator 208 is attached to the first and second arms 214 and 216 to pivot the arms 214 and 216 relative to each other and move the cleaning tools 114 and 116 to their desired relative positions. The actuator can be manually controlled by an operator of the machine 100 through a suitable controller, or be designed to respond automatically to the sensor signal 210 generated by a sensor 209, as discussed above. It is understood that the actuator 208 could be connected to the arms 214 and 216 on the opposite side of the pivotal connection 218 than that shown in FIG. 7.

In one embodiment, cleaning tool support 180 includes a member 220 that is connected to the frame 106 or other component supported on the frame 106 (e.g. the head lift). The member 220 can be connected to the first arm 214, the second arm 216, or the pivotal connection 218. In one embodiment, the member 220 is allowed to rise and fall relative to the frame 106 as represented by the floating connection 222. In another embodiment, the member 220 could have a pivotal connection to the frame 106 when both arms 214 and 216 are pivotally connected to the member 220.

In operation, embodiments of the cleaning tool support 180 described above with respect to FIG. 7 are configured to maintain the cleaning tools 114 and 116 in close proximity or slight engagement with each other during cleaning operations even as they wear. For example, cleaning tools 114' and 116' shown in phantom, illustrate the position of the corresponding horizontal axes 124' and 126' when the cleaning tools are in a relatively non-worn state as compared to a later worn state represented by the cleaning tools 114 and 116. The first and second arms are not shown coupled to the cleaning tools 114' and 116' in order to simplify the illustration. As the cleaning surfaces 113' of the cleaning tools 114' and 116' (phantom) shrink due to wear, one or both of the arms 214 and 216 pivot about the pivotal connection 218 using the actuator 208 (e.g., in response to a sensor signal) to move the horizontal axes 124' and 126' (phantom) relative to each other in the horizontal and vertical directions 192 and 194 within the plane 190 to maintain the close proximity of the cleaning surfaces 113, as illustrated by cleaning tools 114 and 116. In one embodiment, the relative movement of the horizontal axes 124 and 126 to maintain engagement of the cleaning surfaces 113 of the cleaning tools 114 and 116 occurs automatically during cleaning operations and without manual adjustment by an operator of the machine 100.

In accordance with another embodiment, the cleaning tool support 180 is configured to raise one of the cleaning tools 114 and 116 off the floor 110 to a raised position while the other cleaning tool remains in contact with the floor 110 using the actuator 208. In another embodiment, one of the cleaning tools 114 and 116 is in the raised position when it is raised slightly relative to the other cleaning tool, such that the cleaning tool in the raised position applies a lower pressure per unit length to the floor 110 than the other cleaning tool. One purpose of raising one of the cleaning tools off the floor 110 or reducing the pressure it applies to the floor 110, is to preserve the cleaning tool from wear caused by abrasive contact with the surface.

Figure 8:
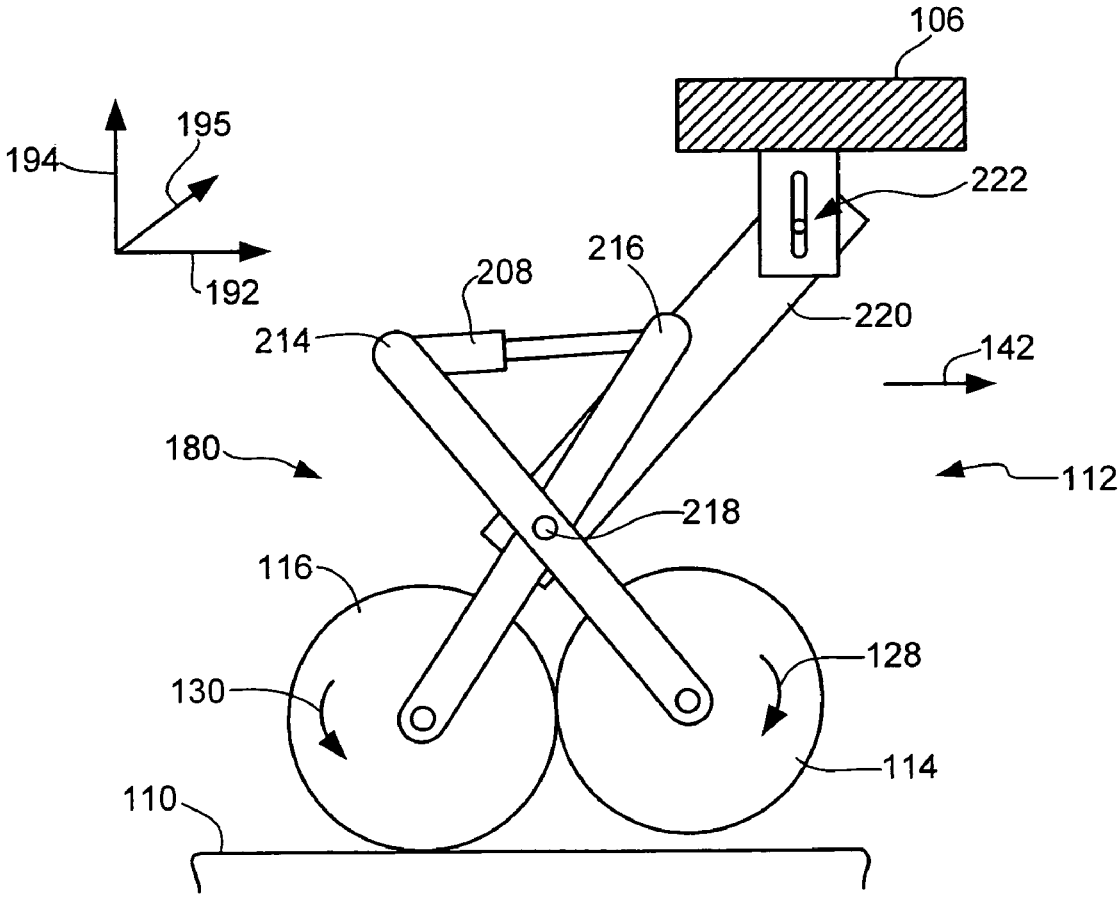
FIG. 8 is a simplified side view of a cleaning head in accordance with embodiments of the invention.
Figure 9:
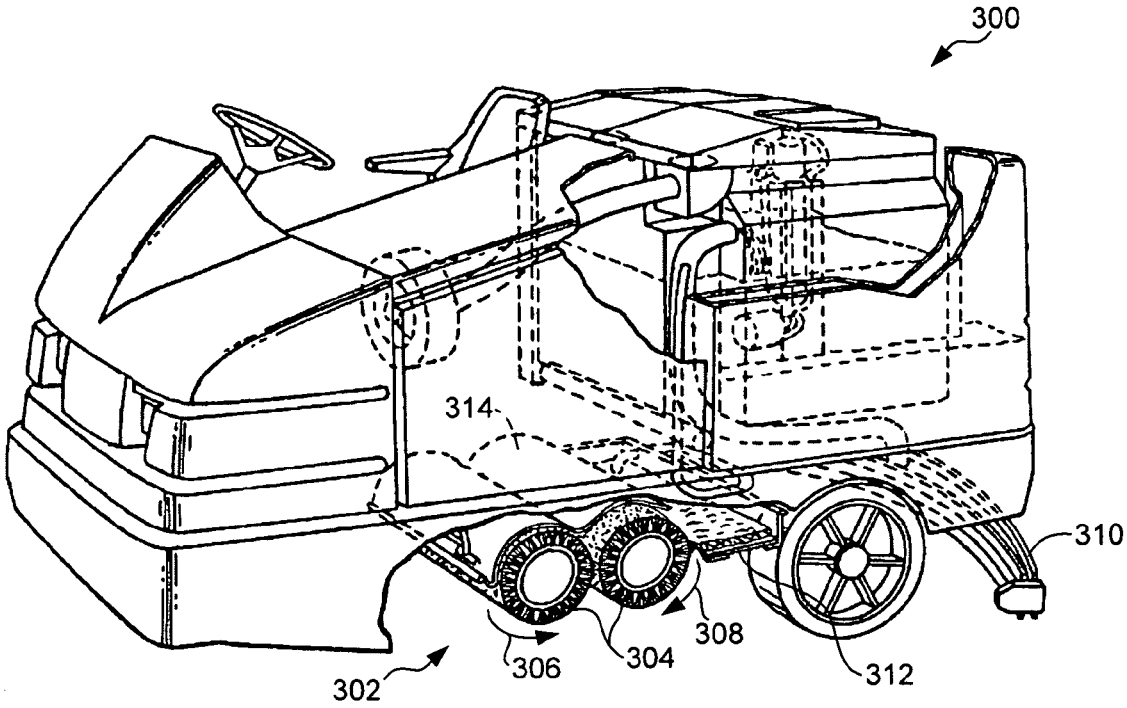
FIG. 9 (PRIOR ART)
FIG. 9 is a perspective view of a hard floor sweeping and scrubbing machine in accordance with the prior art.

In one embodiment, with the forward travel direction of the machine 100 indicated by arrow 142, the leading cleaning tool 114 is raised from the cleaning position (FIG. 7) to the raised position, as shown in FIG. 8, while the trailing cleaning tool 116 remains in contact with the floor during a sweeping operation. During the sweeping operation, the cleaning tools 114 and 116 rotate in the direction indicated by arrows 128 and 130, respectively. Debris swept off the floor 110 by the trailing cleaning tool 116 travels between the cleaning surfaces 113 of the leading and trailing cleaning tools 114 and 116 and is directed into the waste hopper 134 (FIGS. 1 and 2) as discussed above. Accordingly, even though the leading cleaning tool 114 is raised off the floor 110, it still participates in the sweeping of the debris into the waste hopper 134.

One embodiment of the cleaning tool support 180 is configured to move one of the cleaning tools 114 and 116 to the raised position while the other remains in contact with the floor 110 or in the cleaning position. In one embodiment, the first arm 214 of the cleaning tool support 180 is fixed relative to the member 220 while the second arm 216 is allowed to pivot about the pivotal connection 218. The actuator 208 pulls the second arm 216 toward the first arm 214. This causes the trailing cleaning tool 116 to press against the leading cleaning tool 114 and down against the floor 110. Because the first arm 214 is fixed relative to the member 220, the cleaning tools 114 and 116 remain engaged at the cleaning surfaces and the member 220 is driven upward while guided by the floating connection 222. The movement of the member 220 upward results in a slight pivot to the member 220 and the first arm 214, which raises the leading cleaning tool 114 to the raised position while the cleaning tool 116 remains in the cleaning position.

In one embodiment, the cleaning surface 113 of leading cleaning tool 114 is formed differently than the cleaning surface 113 of the trailing cleaning tool 116. In one embodiment, the cleaning surface of the leading cleaning tool 114 is configured for scrubbing operations while the cleaning surface 113 of the trailing cleaning tool 116 is configured for sweeping operations or sweeping and scrubbing operations. For example, the cleaning surface 113 of the leading cleaning tool can include bristles that are shorter and more suitable for scrubbing operations, while the bristles of the cleaning surface 113 of the trailing cleaning tool 116 are longer and better suited for sweeping operations. Accordingly, in accordance with one embodiment of the invention, the cleaning head 112 moves the leading cleaning tool 114 to the raised position during sweeping operations while the trailing cleaning tool 116 remains in engagement with the floor 110 (i.e., cleaning position). For scrubbing operations, at least the leading cleaning tool 114 is moved to the cleaning position for engagement with the floor 110 to perform a scrubbing operation on the floor 110. In one embodiment, both the leading cleaning tool 114 and the trailing tool 116 are lowered to the cleaning positions for performing a scrubbing operation on the floor 110.

Although the present invention has been described with reference to preferred embodiments, workers skilled in the art will recognize that changes may be made in form and detail without departing from the spirit and scope of the invention.

What is claimed is:

1. A cleaning head for use with a floor cleaning machine to perform a cleaning operation on the floor, the cleaning head comprising:

a first cleaning tool configured for rotation about a first horizontal axis and having an exterior cleaning surface configured to engage the floor during floor cleaning operations;

a second cleaning tool configured for rotation about a second horizontal axis and having an exterior cleaning surface configured to engage the surface during floor cleaning operations;

at least one motor configured to respectively drive the rotation of the first and second cleaning tools about the first and second horizontal axes; and a cleaning tool support configured to support the first and second cleaning tools for movement of the first and second horizontal axes relative to each other in a plane that is transverse to the first and second horizontal axes, and to maintain the first and second cleaning tools in engagement with each other during cleaning operations as they wear.

2. The cleaning head of claim 1, further comprising:

a sensor having a sensor output signal that is indicative of a relative position of the first and second cleaning tools; and an actuator coupled to the cleaning tool support and configured to move the first and second cleaning tools relative to each other within the plane in response to the sensor output signal.

3. The cleaning head of claim 2, wherein the cleaning tool support is configured to support the first and second cleaning tools for movement of the first and second horizontal axes relative to each other in a horizontal direction in the plane that is transverse to the first and second horizontal axes during floor cleaning operations.

4. The cleaning head of claim 2, wherein the cleaning tool support is configured to support the first and second cleaning tools for movement of the first and second horizontal axes relative to each other in a vertical direction in the plane that is transverse to the first and second horizontal axes.

5. The cleaning head of claim 2, wherein:

the cleaning tool support comprises a linkage having a first arm coupled to the first cleaning tool, a second arm coupled to the second cleaning tool, and a pivotal connection connecting the first and second arms; and the actuator is connected to at least one of the first and second arms.

6. The cleaning head of claim 2, wherein the actuator comprises a component selected from the group consisting of a linear actuator, a spring and a hydraulic actuator.

7. The cleaning tool of claim 2, wherein the actuator is configured to move the cleaning surfaces of the first and second cleaning tools in close proximity in response to the sensor output signal.

8. The cleaning head of claim 2, wherein the actuator is configured to move the first cleaning tool between raised and cleaning positions while the second cleaning tool is in contact with the floor, wherein the first cleaning tool is raised off the floor when in the raised position and the first cleaning tool is in contact with the floor when in the cleaning position.

9. The cleaning head of claim 8, wherein the first cleaning tool is a leading cleaning tool relative to a forward direction of travel of the floor cleaning machine.

10. The cleaning head of claim 2, wherein the actuator is configured to move the first cleaning tool between raised and cleaning positions while the second cleaning tool is in contact with the floor, wherein the first cleaning tool applies a lower pressure to the floor relative to the pressure applied when the first cleaning tool is in the operating position and a pressure applied to the floor by the second cleaning tool.

11. The cleaning head of claim 1, wherein the exterior cleaning surfaces of the first and second cleaning tools are each configured for a different type of cleaning operation than the other cleaning tool.

12. A cleaning head in a floor cleaning machine used to perform a cleaning operation on a floor, the cleaning head comprising:

a first cleaning tool configured for rotation about a first horizontal axis and having an exterior cleaning surface configured to engage the floor during floor cleaning operations;

a second cleaning tool configured for rotation about a second horizontal axis and having an exterior cleaning surface configured to engage the floor during floor cleaning operations;

at least one motor configured to respectively drive the rotation of the first and second cleaning tools about the first and second horizontal axes; and a cleaning tool support configured to support the first and second cleaning tools for movement of the first and second horizontal axes relative to each other in horizontal and vertical directions in a plane that is transverse to the first and second horizontal axes, wherein the horizontal direction is oriented substantially parallel to the floor and the vertical direction is perpendicular to the horizontal direction.

13. The cleaning head of claim 12, further comprising:

a sensor having a sensor output signal that is indicative of a relative position of the first and second cleaning tools; and an actuator coupled to the cleaning tool support and configured to move the first and second cleaning tools relative to each other within the plane in response to the sensor output signal.

14. The cleaning head of claim 13, wherein:

the cleaning tool support comprises a linkage having a first arm coupled to the first cleaning tool, a second arm coupled to the second cleaning tool, and a pivotal connection connecting the first and second arms; and the actuator is connected to at least one of the first and second arms.

15. The cleaning head of claim 13, wherein the actuator comprises a component selected from the group consisting of a linear actuator, a spring and a hydraulic actuator.

16. The cleaning tool of claim 13, wherein the actuator is configured to move the cleaning surfaces of the first and second cleaning tools in close proximity in response to the sensor output signal.

17. The cleaning head of claim 13, wherein the actuator is configured to move the first cleaning tool between raised and cleaning positions while the second cleaning tool is in contact with the floor, wherein the first cleaning tool is raised off the floor when in the raised position and the first cleaning tool is in contact with the floor when in the cleaning position.

18. The cleaning head of claim 17, wherein the first cleaning tool is a leading cleaning tool relative to a forward direction of travel of the floor cleaning machine.

19. The cleaning head of claim 13, wherein the actuator is configured to move the first cleaning tool between raised and cleaning positions while the second cleaning tool is in contact with the floor, wherein the first cleaning tool applies a lower pressure to the floor relative to the pressure applied when the first cleaning tool is in the operating position and a pressure applied to the floor by the second cleaning tool.

20. A floor cleaning machine configured to perform a floor cleaning operation on a floor, the machine comprising:

a mobile body comprising a frame having wheels for travel over the floor;

a cleaning head attached to the mobile body, the cleaning head comprising:

a first cleaning tool configured for rotation about a first horizontal axis and having an exterior cleaning surface configured to engage the floor during floor cleaning operations;

a second cleaning tool configured for rotation about a second horizontal axis and having an exterior cleaning surface configured to engage the floor during floor cleaning operations;

at least one motor configured to respectively drive the rotation of the first and second cleaning tools about the first and second horizontal axes; and a cleaning tool support configured to support the first and second cleaning tools for movement of the first and second horizontal axes relative to each other and the frame in a plane that is transverse to the first and second horizontal axes; and a sensor configured to sense the relative positions of the first and second cleaning tools and having a sensor output signal that is indicative of a position of the first cleaning tool relative to the second cleaning tool; and an actuator coupled to the cleaning tool support and configured to move the first and second cleaning tools relative to each other within the plane in response to the sensor output signal.

* * * * *

UNITED STATES PATENT AND TRADEMARK OFFICE

CERTIFICATE OF CORRECTION

PATENT NO. : 7,665,174 B2
APPLICATION NO. : 11/429398
DATED : February 23, 2010
INVENTOR(S) : Basham et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 711 days.

Signed and Sealed this

Seventh Day of December, 2010

David J. Kappos

David J. Kappos
*Director of the United States Patent and Trademark Office*